United States Patent [19]

Larson

[11] 4,124,377

[45] Nov. 7, 1978

[54] METHOD AND APPARATUS FOR PRODUCING ATOMIZED METAL POWDER

[75] Inventor: Ulf Rutger Larson, Ljungby, Sweden

[73] Assignee: Rutger Larson Konsult AB, Sweden

[21] Appl. No.: 817,154

[22] Filed: Jul. 20, 1977

[51] Int. Cl.[2] ..... B22D 23/08

[52] U.S. Cl. ..... 75/0.5 C; 264/11; 264/12; 264/13; 264/14

[58] Field of Search ..... 75/0.5 C; 264/11, 12, 264/13, 14; 425/6, 7

[56] References Cited

U.S. PATENT DOCUMENTS

| | | | |
|---|---|---|---|
| 2,113,279 | 4/1938 | Olin et al. | 264/14 |
| 2,159,433 | 5/1939 | Ervin | 75/0.5 C |
| 2,287,029 | 6/1942 | Dowdell | 264/13 |
| 2,460,993 | 2/1949 | Le Brasse et al. | 425/7 |
| 3,551,532 | 5/1967 | Laird | 264/11 |

*Primary Examiner*—W. Stallard

[57] ABSTRACT

A method and apparatus for producing metal powder in which a reducing liquid is introduced into the bottom of a substantially closed granulation chamber, and a reducing gaseous atmosphere is produced above the reducing liquid. A stream of molten metal is introduced into the top of the granulation chamber and is acted upon by one or more jets of a pressurized atomizing agent which atomizes the molten metal stream. Metal particles are cooled at least partly in the reducing gaseous atmosphere and are collected in the reducing liquid in the bottom of the chamber, from which they can be withdrawn.

6 Claims, 5 Drawing Figures

O tot ppm
400
300
200
100
0
500
1000
1500
μM

C%
0.70
0.60
0.50
0.40
0.30
500
1000
1500
μM

METHOD AND APPARATUS FOR PRODUCING ATOMIZED METAL POWDER

The present invention relates to a method and apparatus for producing metal powder by atomizing molten metals.

One such method involves producing a casting stream of molten metal which is brought into contact with a gaseous and/or liquid atomizing or spraying agent.

Atomization of molten metal with atomizing agents such as compressed air, nitrogen, argon, water vapour or water under pressure is already known. The molten metal is supplied from a casting vessel provided with a hole at the bottom which is placed above one or more nozzles. A casting stream flows through the hole and meets the atomizing agent which is expelled at high speed, so that the casting stream is disintegrated into fine drops. It has been found that metal powder produced in this manner absorbs oxygen from the atomizing agent during manufacture, primarily as surface oxygen which reacts with easily oxidising alloying elements.

In order to bring down the oxygen content to an acceptable level in alloyed steel, for example, pulverisation has been performed earlier using nitrogen or argon instead of the more usual pulverisation with water or water vapour. This means that an atomizing medium (a gas) has been used which is considerably more expensive and has noticeably poorer disintegrating and cooling properties. For certain purposes, for example the production of powder having spherical particles, however, gas atomization is preferred so that the powder particles have a chance to contract to spherical shape.

Problems exist in the manufacture of special alloyed powder with low oxygen content if a fine-grained product is desired. A greater quantity of gas is required for this and a considerably greater proportion of oxygen from the oxygen remnants of the inert gases will therefore come into contact with the molten casting stream, thus resulting in higher oxygen contents in the powder formed. The use of oxidizing atomizing agents, such as water, gives the reverse effect, i.e. an increased quantity of water will give a reduction in the oxygen content of the powder due to the more rapid cooling process. However, it is not possible to achieve such low contents as with atomization with nitrogen gas or argon.

According to the invention there is provided a method of producing metal powder, said method comprising the steps of providing a substantially closed granulation chamber, providing a reducing liquid in the lower part of said chamber and a reducing gaseous atmosphere above said reducing liquid, melting the metal of which the powder is to be formed, producing a casting stream of the molten metal in the reducing gaseous atmosphere of said substantially closed vessel, subjecting said stream to pressurized atomizing agent to atomize the stream, cooling the metal particles at least partly in said reducing gaseous atmosphere and collecting the resulting powder in the reducing liquid.

With such a method it is possible to eliminate the drawbacks mentioned above and effect a method of manufacturing atomized metal powder with extremely low oxygen contents.

In the method according to the invention, a casting stream is subjected to a reducing atomizing medium, preferably gaseous or liquid hydrocarbon or a mixture thereof, for instance petroleum products such as liquified petroleum, oil, benzene or the like. In order to protect the powder against oxidation, the actual pulverization process is performed in a closed granulation chamber which is partially filled with liquid medium and is under pressure from gaseous reducing agent. This also avoids any risk of explosion. One advantage with the method of manufacture proposed in accordance with the invention is also that by regulating the quantity of atomizing medium, such as oil, in relation to the quantity of metal, the carbon content in the finished powder can be regulated.

The invention also provides apparatus for producing metal powder comprising a substantially closed granulation chamber, a casting vessel having an outlet communicating with the upper part of said granulation chamber to produce a molten metal stream in said granulation chamber, an outlet valve in the lower part of said granulation chamber and a gas inlet in the upper part thereof, at least one atomizing agent nozzle arranged to direct at least one atomizing agent jet against said molten metal stream to disintegrate the stream and a liquid lock on said granulation chamber.

In order that the invention may more readily be understood, the following description is given, merely by way of example, reference being made to the accompanying drawings, in which.

Figure 1:
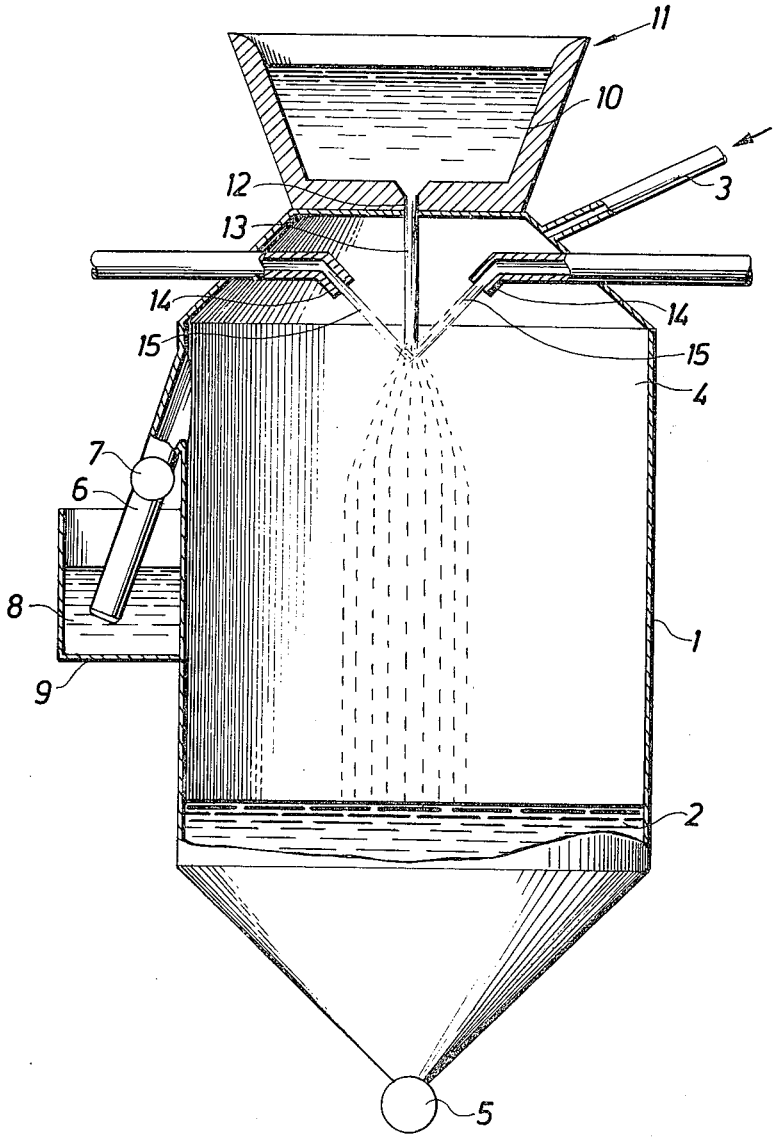
FIG. 1 is a schematic view of one embodiment of apparatus in accordance with the invention.
Figure 2:
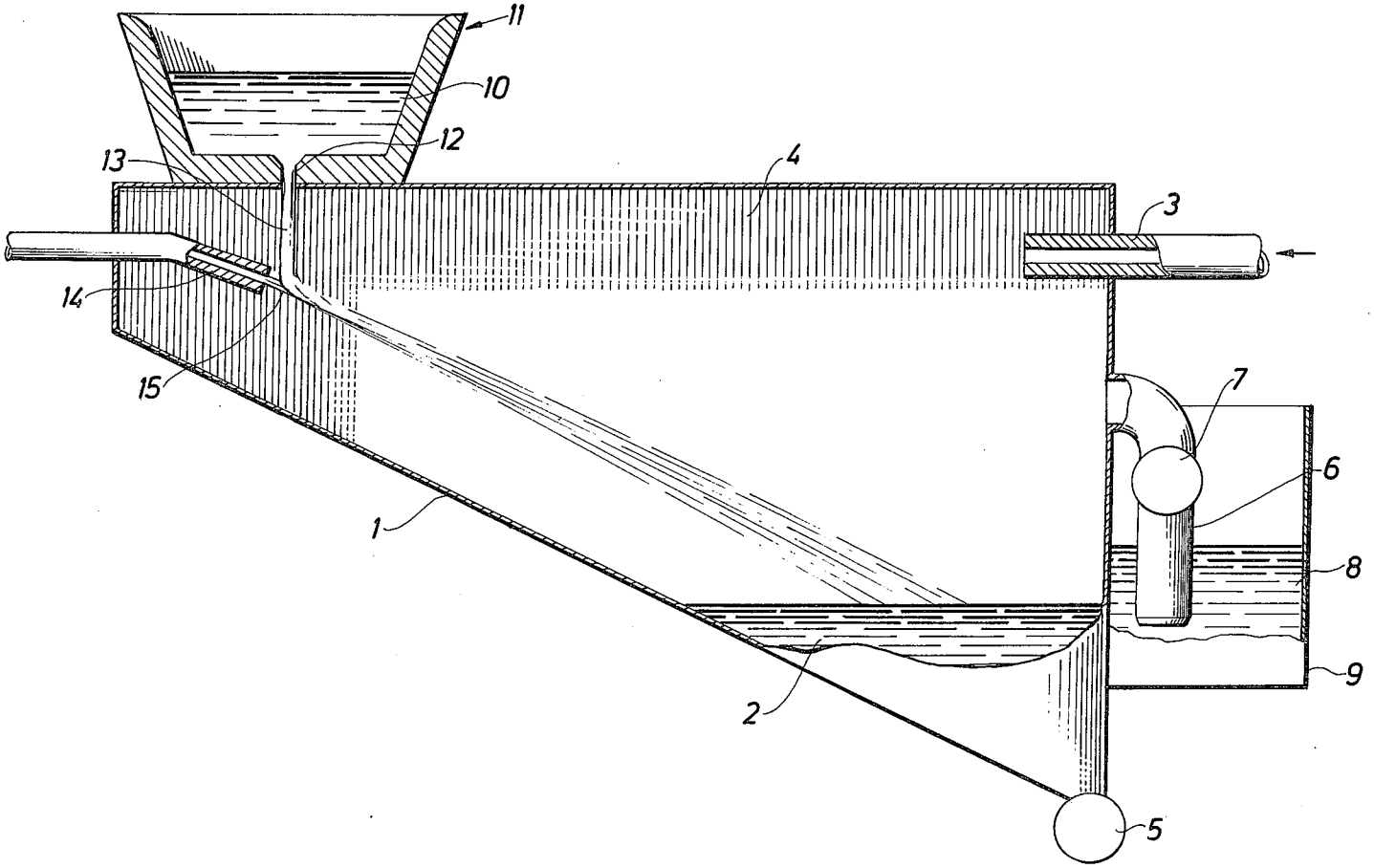
FIG. 2 is a similar view of a second embodiment.

In the drawings, a granulation chamber 1 is partly filled with a reducing liquid 2, for instance oil, preferably fuel oil comprising 86.8% carbon, 12.5% hydrogen, 0.58% sand and the remainder including ash 0.12%. The chamber 1 is provided with a bottom teeming aperture 12 in communication with a casting vessel 11 containing a metal melt 10. An inlet 3 is provided in the upper part of the chamber 1 for reducing gas and nozzles 14 protrude into the chamber for the supply of a reducing atomizing agent 15. In the embodiments shown in FIGS. 1 and 2, a liquid lock, in the form of a channel 9, is provided. The channel 9 co-operates with tube 6 communicating via valve 7 with the chamber 1, the open end of the tube being below the liquid level of a liquid 8 in the channel 9.

Before pulverization commences, the valve 7 and bottom valve 5 are closed, after which the granulation chamber 1 is filled with a reducing liquid up to the draw hole 12. When the granulation chamber is completely filled, a reducing gas is supplied through the tube 3 at the same time as the liquid level is lowered to the level desired for the pulverization process. The valve 7 is then opened, whereupon the reducing gas 4 in the upper part of the granulation chamber 1 will maintain a superatmospheric pressure corresponding to the length of the pipe 6 which is immersed in the liquid 8 in the liquid lock channel 9. The actual pulverization process may now be performed. Molten metal 10 from the casting vessel 11 runs down through the draw hole 12 in the form of a metal stream 13 which is hit by the reducing atomizing agent 15 expelled from the nozzles 14.

Figure 3:
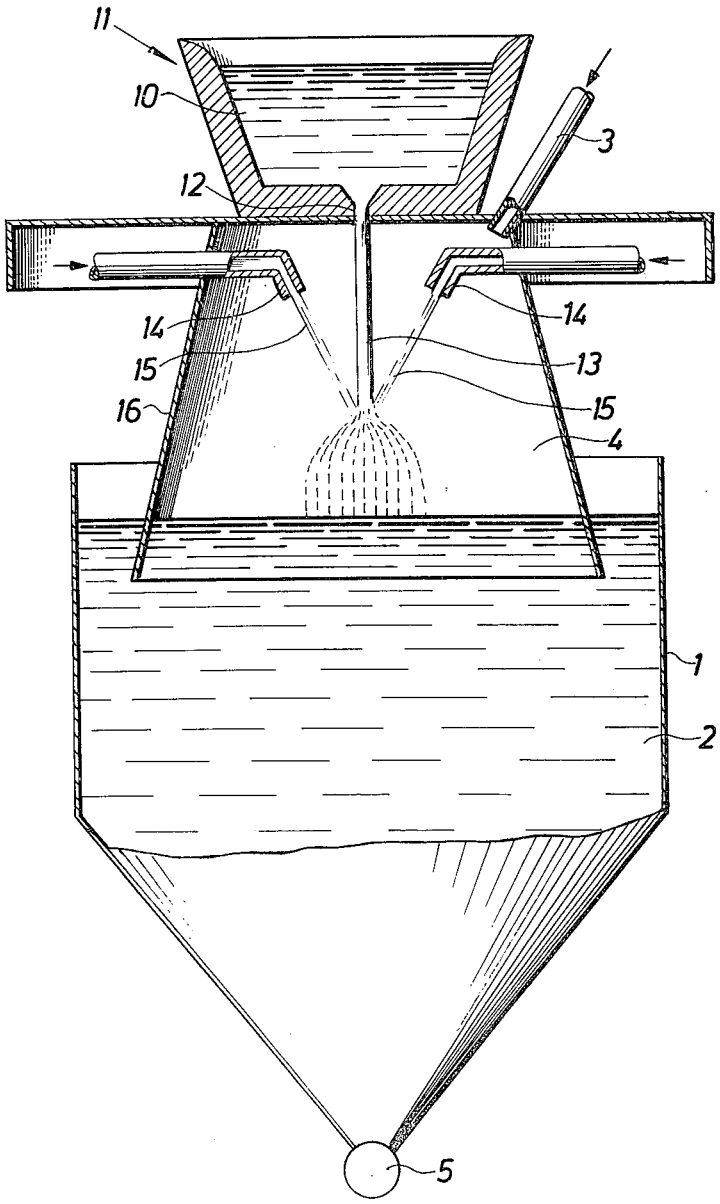
FIG. 3 is a similar view of a third embodiment.

FIG. 3 shows a further embodiment of apparatus according to the invention in which the liquid lock function has been achieved by dividing the granulation chamber into a lower upstanding wall 1 and an upper depending wall 16, these parts being displaceable in relation to each other. When the chamber is filled with liquid before being filled with gas, the lower part 1 is raised or the upper part 16 may be lowered, the lower part acting as the tube 6 of the liquid lock in accordance with FIGS. 1 and 2. The advantage of the embodiment shown in FIG. 3 is that the liquid lock has large dimension and is therefore more reliable in function.

The invention is of course not limited to the embodiments shown in the drawings but can be varied in many ways. For example, the atomizing medium may thus consist of hydrocarbon, special oil, and liquified petroleum, or even benzene, methane or the like. Even silicons can be used. Admittedly silicons contain oxygen but practical tests have shown that the silicons have a stable viscosity within a wide temperature range and can therefore probably also be used in the present context.

EXAMPLE

When casting about 10 kg of steel the steel was allowed to pour from a ladle to a graphite crucible having an outlet opening with a diameter of 6.5 mm. The molten casting stream was atomized to powder by means of oil (fuel oil) from four opposing, downwardly directed nozzles. Argon was used as protective gas, but of course other gases such as nitrogen could also have been used. The quantity of oil used in this example was about 500l/min. and the pressure was 5.5. kg/cm$^2$. It is clear from the example that the atomization with oil performed in accordance with the invention results in extremely low oxygen contents in the powder as well as a certain carburization effect. The powder produced was found to consist of particles varying in shape, cigar-shaped, potato-shaped and spherical, whereupon it could be determined that the finer particles were for the most part spherical and the elongate particles were to be found primarily amongst the coarser fractions.

The mesh analysis of the powder produced gave the following result:

| | mesh width | % powder |
|---|---|---|
| | 3360 microns | 0.37 |
| | 1680 microns | 2.03 |
| | 841 microns | 18.36 |
| | 595 microns | 23.80 |
| | 420 microns | 24.85 |
| | 210 microns | 24.66 |
| | 149 microns | 4.26 |
| | 105 microns | 1.30 |
| | 74 microns | 0.23 |
| | 53 microns | 0.12 |
| powder | 53 microns | 0.02 |

Figure 4:
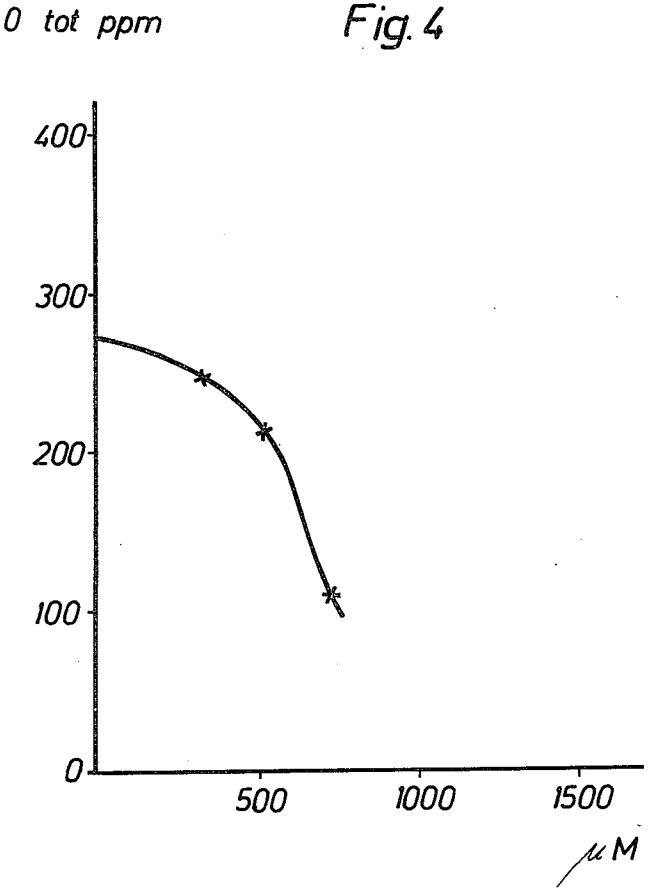
FIGS. 4 and 5 are graphs showing the total oxygen content and carbon content respectively for various particle sizes.
Figure 5:
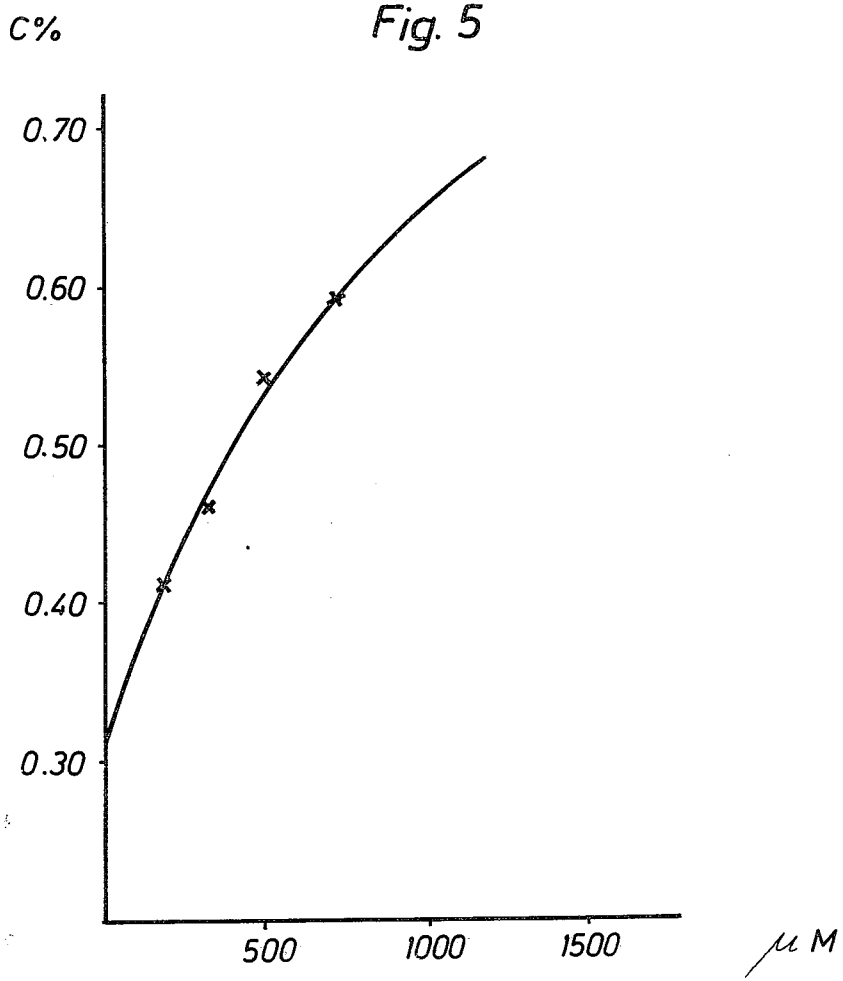

The total oxygen content in the various particle sizes can be seen from FIG. 4 and the carbon content in the various particle sizes from FIG. 5. With respect to the oxygen content, it may be mentioned by way of comparison that conventionally manufactured iron powder of this coarse type containing 1.2 % Mn has an oxygen content of 0.76 – 1% (i.e. 7600 – 10000 ppm).

Chemical analysis of the steel otherwise revealed the following:

| | % |
|---|---|
| Si | 0.57 |
| Mn | 1.30 |
| P | 0.017 |
| S | 0.021 |
| Cr | 0.16 |
| Ni | 0.03 |
| Mo | 0.03 |
| Cu | 0.05 |
| V | 0.01 |
| Ti | 0.01 |
| Al | 0.007 |

The oxygen content of the steel was 86 ppm.

I claim:

1. A method of producing metal powder, said method comprising the steps of providing a substantially closed granulation chamber, providing a reducing liquid in the lower part of said chamber and a reducing gaseous atmosphere above said reducing liquid, melting the metal of which the powder is to be formed, producing a casting stream of the molten metal in the reducing gaseous atmosphere of said substantially closed vessel, subjecting said stream to pressurised hydrocarbon atomizing agent to atomize the stream, cooling the metal particles at least partly in said reducing gaseous atmosphere and collecting the resulting powder in the reducing liquid.

2. A method as claimed in claim 1, wherein the atomizing agent is of a reducing nature.

3. A method as claimed in claim 1, wherein the atomizing agent, the reducing gaseous atmosphere and the reducing liquid are hydrocarbons.

4. A method as claimed in claim 1, wherein the hydrocarbons are liquified petroleum, oil, benzene or silicone hydrocarbon compounds.

5. A method as claimed in claim 1, wherein the space above the reducing liquid in the granulation chamber is above atmospheric pressure.

6. A method as claimed in claim 1, wherein the entire granulation chamber is initially filled with said reducing liquid, the reducing gaseous medium is thereafter introduced into the upper part of the chamber, as the level of liquid is lowered, the stream of molten metal is then introduced into the upper part of the chamber and subjected to the action of the pressurized atomizing agent and the powder thus obtained is collected in said liquid, a constant super-atmospheric pressure being maintained in the granulation chamber.

* * * * *